US005116314A

United States Patent [19]

Inabinet

[11] Patent Number: 5,116,314

[45] Date of Patent: May 26, 1992

[54] MEDICATING DEVICE FOR ANIMALS

[76] Inventor: Lawrence E. Inabinet, 1-B Greenwood Park, Marion, S.C. 29571

[21] Appl. No.: 608,676

[22] Filed: Nov. 5, 1990

[51] Int. Cl.[5] ..... A61J 7/00

[52] U.S. Cl. ..... 604/77

[58] Field of Search ..... 604/77-79, 604/59-64; 128/14; 119/159, 134, 71, 51.01, 72; 222/457.5, 460, 560, 465.1; D7/533-536, 700

[56] References Cited

U.S. PATENT DOCUMENTS

| | | | |
|---|---|---|---|
| D. 186,535 | 11/1959 | Saffer | D7/535 |
| D. 238,648 | 2/1976 | Jablecki | D7/700 |
| 323,183 | 7/1885 | Marvin | 604/79 |
| 382,688 | 5/1888 | Cady | 640/79 |
| 537,695 | 4/1895 | Manseau | 604/77 |
| 1,241,952 | 10/1917 | French | 604/59 |
| 1,266,383 | 5/1918 | Baker | 604/79 |
| 1,476,500 | 12/1923 | Emonts | 604/79 |
| 1,550,618 | 8/1925 | Kemp | D7/536 |
| 2,280,853 | 4/1942 | Rody | 54/7 |
| 4,060,083 | 11/1977 | Hanson | 128/223 |
| 4,773,898 | 9/1988 | Begouen | 604/79 |

*Primary Examiner*—C. Fred Rosenbaum
*Assistant Examiner*—William W. Lewis
*Attorney, Agent, or Firm*—Michael A. Mann

[57] ABSTRACT

A device for orally administering medication to an animal, the device having a chamber attached to one end of a wire and a series of four loops attached at the other end of the wire. The wire is curved so that it will hold the chamber at the back of the animal's mouth, near the throat, and will curve behind the teeth of the animal and exit the side of the animal's mouth, then run approximately parallel to the outside of the mouth to the front of the jaw. The animal handler can insert the fingers of one hand into the four loops and hold the device with his palm under the animal's jaw with the chamber in position in the animal's mouth. When the device and animal's jaw are lifted, the medication drops into the animal's throat.

12 Claims, 1 Drawing Sheet

Fig. 1
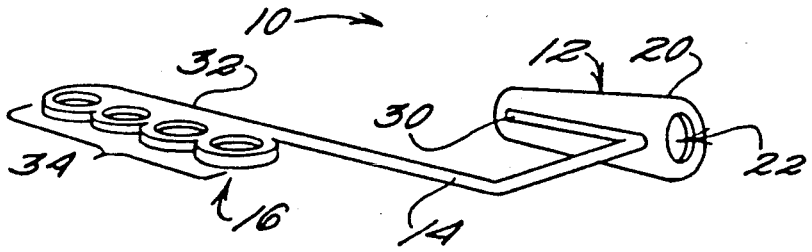
Fig. 2
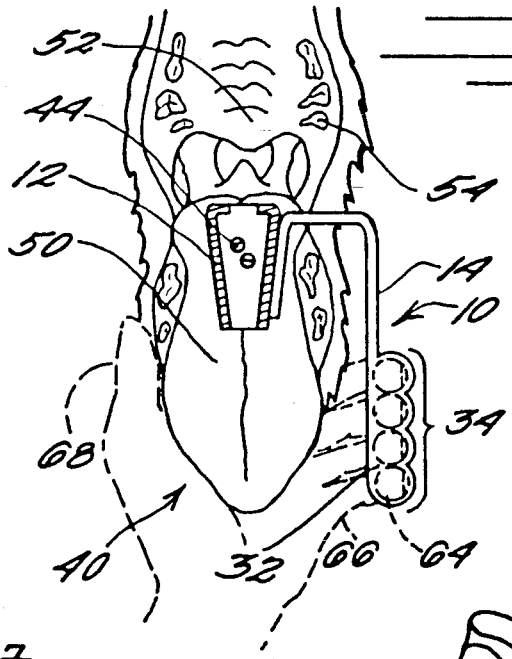
Fig. 3
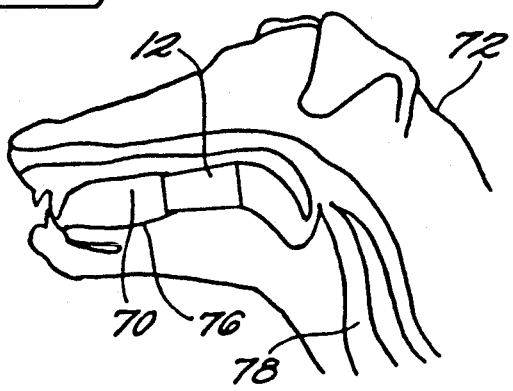
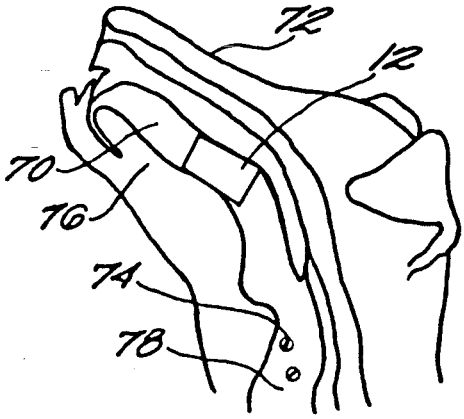
Fig. 4

MEDICATING DEVICE FOR ANIMALS

BACKGROUND OF THE INVENTION

1. Field of the Invention

The present invention relates to devices for administering medication to animals. More particularly, the present invention is a device for administering medication to animals orally.

2. Discussion of the Background

Devices for administering medication to animals have existed for some time. See for example Hanson's Pill Gun described in U.S. Pat. No. 4,060,083 or Emont's Veterinary Instrument described in U.S. Pat. No. 1,476,500. Other examples can be found in U.S. Pat. Nos. 2,280,853, 1,266,383, 1,241,952, 537,695, and 323,183.

Many of these devices are elaborate or have chambers that open mechanically inside the animal's mouth. Many are likely to cause distress for the animal and be therefore more difficult to use, especially for someone who is not trained in animal handling.

There is a need for a device that will allow someone to administer medication orally to animals, a device that is easy to use, effective, and non-distressing.

SUMMARY OF THE INVENTION

According to its major aspects, the present invention is a device for orally administering medication to animals comprising a chamber on the end of a wire with a series of loops for gripping at the other end of the wire. The chamber is dimensioned to contain the medication and to fit into the mouth of the animal. Further, the chamber has an opening directed toward the throat of the animal when the device is positioned in the animal's mouth which chamber tapers towards that opening. The wire is curved so as to be generally "U" shaped, passing behind the teeth of the animal and exiting the mouth of the animal at the side of its head and running approximately parallel to the outside of the animal's mouth toward the front of the animal's jaw.

It is a feature of the present invention that the wire passes behind the teeth of the animal before exiting the animal's mouth. The advantage of this feature is that the animal's mouth can be completely closed when its head is tilted back to release the medication from the chamber. It is also an advantage that the animal is not biting down on any portion of the device, which may damage the animal's teeth or the device itself, and which would distress the animal.

It is another feature of the present invention that the gripping means, in the preferred embodiment is a series of loops dimensioned for the fingers of one hand and located near the front of the animal's jaw and generally parallel thereto. The advantages of this feature are that, first, the device can be securely gripped, and, second, the device is held by placing the hand under the animal's jaw and inserting the fingers into the loops while the hand is still under the jaw. This position allows the handler to control the animal's jaw for operation of the device and to establish reassuring contact with the animal.

Another feature of the present invention is that the chamber is tapered toward its opening, this allows the chamber to retain the medication until the animal's jaw is tilted to a substantial degree, approximately 45° or more, so that the medication drops into the animal's throat rather than simply rolling out of the container onto the back of the tongue where it can cause distress to the animal.

Other features and advantages of the present invention will be apparent to those skilled in the art of devices for orally administering medication to animals from a careful reading of the Detailed Description of a Preferred Embodiment accompanied by the appended drawings.

BRIEF DESCRIPTION OF THE DRAWINGS

In the drawings,

FIG. 1 is a perspective view of a preferred embodiment of the present invention;

FIG. 2 is a top view of the preferred embodiment of the present invention in position in the mouth of an animal;

FIG. 3 is a side view of a portion of the present invention in position in an animal's mouth with the animal's head level; and FIG. 4 is another side view of a portion of the invention in position in an animal's mouth with the animal's head raised to allow the medication to fall.

DETAILED DESCRIPTION OF A PREFERRED EMBODIMENT

Referring now to FIG. 1, there is shown in perspective the present device in a preferred embodiment. The device is for administering orally medication to animals. Medication is typically in the form of pills or capsules but the present device may also be used to administer liquids. The device is operated by one hand, a human hand, manipulating the device and the animal's jaw.

The device can of course be sized to fit a variety of animals, such as dogs, cats, horses, cows, sheep and so on. It is intended for animals with heads having jaws, teeth, tongues and a throat.

The device, generally indicated by reference character 10 has a chamber 12, a wire 14, and a gripping means 16. The chamber can be any shape but is preferably wider in the middle 20 that at the opening 22. The wire has two ends: a first end 30 which is attached to chamber 12 by any convenient means such as welding, brazing or gluing, or may be integral with chamber 12; the second end 32 is attached to gripping means 16 which is at least one loop dimensioned to receive the fingers and, preferably, as shown in FIG. 1, is four loops 34 dimensioned to receive the fingers of one hand.

The relative positions of chamber 12 and gripping means 16 and the animal's physical features are crucial. As seen in FIG. 2, which is a top view of an animal's lower jaw 40 with device 10 in place and wire 14 assuring the correct positions. Chamber 12, shown partially cut away with two pills 44 therein, is positioned at the back of the animal's tongue 50 near its throat 52, with opening 22 directed towards throat 52. Wire 14, holding chamber 12 in place curves behind teeth 54 and exits the animal's mouth 56, then runs generally parallel to the outside of mouth 56 towards the front of the jaw 56.

At second end 32, four loops 34 are positioned so that the fingers 64 of one hand can be inserted up to the first joint while the palm 66 of the hand is under jaw 40 of the animal and thumb 68 is on the other side of jaw 40. Thus four loops 34 must not be to far forward of jaw 40 or chamber 12 to far back on tongue 50. If four loops 34 are too far forward, the hand holding the device will not be positioned under jaw 40. If chamber 12 is too far back, it will be uncomfortable and distressing to the animal.

FIGS. 3 and 4 illustrate the method for using device 10. For clarity, wire 14 is not shown but chamber 12 is seen positioned at the back of the mouth 70 of the animal near its throat 78, the animal's head 72 level (FIG. 3). Medication, such as a pill 74, has been placed in chamber 12, device 10 put into position with wire 14 on the animal's tongue 76, and the fingers of the hand inserted to the first joint into four loops 34 (not shown in FIG. 4). Then the head 72 of the animal is raised (FIG. 4) to an angle such as at least approximately 45° so that pill 74 drops into the throat of the animal.

It will be apparent to those skilled in the art of administering medication to animals that various modifications and additions could be made to the preferred embodiment without departing from the spirit and scope of the present invention which is to be defined by the appended claims.

What is claimed is:

1. A device for orally administering medication to animals, the device comprising:

a chamber dimensioned to contain said medication and to fit into the mouth of an animal, said chamber having an opening;

a wire having a first end and a second end, said first end attached to said chamber, said wire curved to pass behind the teeth of said animal and exit the mouth of said animal to the side of the head of said animal; and means for gripping said wire carried by said second end of said wire, said gripping means having at least one loop dimensioned to receive fingers of a human being.

2. The device as recited in claim 1, wherein said gripping means further comprises four consecutive loops carried by said second end of said wire, said loops dimensioned to receive the fingers of one hand.

3. The device as recited in claim 2, wherein said wire further curves so that said second end runs approximately parallel to the outside of the mouth of said animal and to the end of the jaw of said animal.

4. The device as recited in claim 1, wherein said wire holds said chamber with said opening of said chamber directed towards the throat of said animal.

5. The device as recited in claim 1, wherein said wire holds said chamber at the back of said mouth of said animal near the throat of said animal.

6. The device as recited in claim 1, wherein said chamber is formed so that it is wider in the middle than at said opening so that said chamber must be tilted to an angle of more than approximately 45° to release said medication.

7. The device as recited in claim 1, wherein said wire further curves so that said second end runs approximately parallel to the outside of the mouth of said animal.

8. A device for orally administering medication to animals, the device comprising:

a chamber dimensioned to contain said medication and to fit into the mouth of an animal, said chamber having an opening, said chamber tapered toward said opening;

a wire having a first end and a second end, said first end attached to said chamber, said wire curved to pass behind the teeth of said animal, to exit the mouth of said animal to the side of the head of said animal, and to run approximately parallel to the outside of the mouth of said animal; and means for gripping said wire carried by said second end of said wire, said gripping means extending not further than the end of the mouth of said animal and adapted for gripping by a human hand, said gripping means having at least one loop dimensioned to receive human fingers.

9. The device as recited in claim 8, wherein said gripping means further comprises four consecutive loops carried by said second end of said wire, said loops dimensioned to receive the fingers of one hand.

10. The device as recited in claim 8, wherein said wire holds said chamber near the throat of said animal with said opening of said chamber directed towards the throat.

11. A method of administering medication to an animal with a device having a chamber dimensioned to contain said medication and to fit into the mouth of an animal, said chamber having an opening, said chamber tapered toward said opening;

a wire having a first end and a second end, said first end attached to said chamber, said wire curved to pass behind the teeth of said animal, to exit the mouth of said animal to the side of the head of said animal, and to run approximately parallel to the outside of the mouth of said animal; and means for gripping said wire carried by said second end of said wire, said gripping means extending not further than the end of the mouth of said animal and adapted for gripping by a human hand, said method comprising the steps of:

placing medication into said chamber;

placing said chamber of said device on the tongue of said animal near the throat of said animal with said opening directed towards the throat and said wire behind the teeth of said animal;

gripping said gripping means; and tilting the head of said animal upwardly so that said medication falls into the throat of said animal.

12. The method as recited in claim 11, wherein said gripping means further comprises four loops dimensioned to receive the fingers of one hand, and said method further comprises the steps of:

placing a hand under the jaw of said animal; and inserting the fingers of said hand into said four loops.

* * * * *